US007326084B1

(12) United States Patent
Chen et al.

(10) Patent No.: US 7,326,084 B1
(45) Date of Patent: Feb. 5, 2008

(54) ELECTRONIC MODULE OF ELECTRIC CONNECTOR

(75) Inventors: Li-Sen Chen, Taoyuan Hsien (TW); Chien-Yu Hsu, Taoyuan Hsien (TW); Robert Jiang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/309,679

(22) Filed: Sep. 11, 2006

(51) Int. Cl.
*H01R 13/66* (2006.01)

(52) U.S. Cl. ..... 439/620.23

(58) Field of Classification Search ..... 439/620.21–620.23
See application file for complete search history.

(56) References Cited

U.S. PATENT DOCUMENTS 5,069,641 A * 12/1991 Sakamoto et al. ..... 439/620.22
5,656,985 A 8/1997 Lu et al. ..... 336/96
6,159,050 A * 12/2000 Belopolsky et al. ... 439/620.23
6,319,064 B1 11/2001 Belopolsky et al. ... 439/620.19
6,527,594 B1 * 3/2003 Korsunsky et al. ..... 439/676
6,572,412 B2 * 6/2003 Beuther et al. ..... 439/620.21
6,593,840 B2 7/2003 Morrison et al. ..... 336/192
6,912,781 B2 7/2005 Morrison et al. ..... 29/854
7,153,158 B1 * 12/2006 Lee ..... 439/541.5
7,182,649 B2 * 2/2007 Caveney et al. ..... 439/676
2002/0106939 A1 * 8/2002 Beuther et al. ..... 439/620

* cited by examiner

*Primary Examiner*—Gary Paumen
(74) *Attorney, Agent, or Firm*—Jianq Chyun IP Office

(57) ABSTRACT

An electronic module of an electric connector suitable for being electrically connected to a terminal set inside the electric connector is provided. A plurality of connection terminals is installed on the terminal set for electrically connecting other devices. The electronic module includes: a holder having an accommodating space, wherein a plurality of terminal channels is disposed around and communicated with the accommodating space; at least one electronic component, disposed in the accommodating space of the holder, and having at least one conductive lead extending outside the accommodating space; and a plurality of auxiliary terminals with each having a connection end and an insertion end disposed in the terminal channels, wherein the insertion ends correspondingly inserted into the terminal channels lead the conductive leads into the terminal channels, so as to electrically connect the conductive leads. In addition, the connection ends are electrically connected to the connection terminals.

17 Claims, 8 Drawing Sheets

ELECTRONIC MODULE OF ELECTRIC CONNECTOR

BACKGROUND OF THE INVENTION

1. Field of Invention

The present invention relates to an electronic module. More particularly, the present invention relates to an electronic module of an electric connector.

2. Description of Related Art

Generally, electronic apparatuses, such as notebooks, all require different electric connectors of various functions built therein, so as to, for example, electrically connecting a mother board to an electronic device, such as an external floppy disk drive. Besides electrically connecting two electronic devices, an electric connector also has other functions, such as filtering noises.

FIG. 1 is a sectional view of a modular jack with filter insert and contact thereof disclosed by U.S. Pat. No. 6,319,064. Referring to FIG. 1, the electric connector has a built-in filter 100 disposed in a space defined by an insulative housing 102, an insulative insert 104 and a cap 106. Additionally, the filter 100 has a plurality of conductive leads 108 extending upward and a plurality of conductive leads 110 extending downward. The conductive leads 108 extending upward are electrically connected to a conductive lead 112 fixed on the insulative insert 104 respectively, and the conductive leads 110 extending downward are respectively connected to contacts 114 or 116. U.S. Pat. No. 6,319,064 from Column 7, Line 11 describes performing a solder bath to a first elongate portion 114*a* of the contact 114, so as to be welded to a corresponding conductive lead 110 extending downward, wherein the conductive lead 110 is a metal wire and the contact 114 is a board. As the metal wire and board are difficult to be welded together, the product of U.S. Pat. No. 6,319,064 is unsuitable for mass production.

FIG. 2 is a sectional view of an electronic component package structure containing a toroid filter coil disclosed by U.S. Pat. No. 5,656,985. Referring to FIG. 2, the package structure comprises a toroid transformer 200 and a package 202, wherein the toroid transformer 200 has a plurality of conductive leads 204 and the package 202 has a plurality of terminals 206. Each terminal 206 has a notch 206*a*. Each wire 204 wraps the notch 206*a*, such that the toroid transformer 200 is electrically connected to each terminal 206. However, if the volume of the mount package is small, it is quite difficult to wrap the wire 204 on the notch 206*a*. As for the above situation, the product of U.S. Pat. No. 5,656,985 is unsuitable for mass production.

FIG. 3 is a sectional view of an electronic component package structure that can be inserted by conductive leads disclosed by U.S. Pat. No. 6,593,840 and No. 6,912,781. Referring to FIG. 3, the packaging device includes a retainer 300, a base member 302 and an electronic component 304. The base member 302 has a lead channel 302*a* and the electronic component 304 has at least one conductive lead 304*a*, wherein each conductive lead 304*a* of the electronic component extends outside the base member 302 through the lead channel 302*a*. Additionally, the retainer 300 has a plurality of terminals 300*a* and each of the terminals can be placed into the lead channel 302*a*. Via the assembly of the retainer 300 and the base member 302, the conductive leads 304*a* in the lead channel 302*a* are pressed against and electrically connected to the terminals 300*a* in the lead channel 302*a*. However, the aforementioned connection between the conductive leads 304*a* and the terminals 300*a* can hardly achieve a satisfactory effect. The reason is that, under the trend of minimization of the package structure, the conductive leads 304*a* have low mechanical strength due to their quite small diameters. As such, during the assembling process, the terminals 300*a* on the retainer 300 may pull apart the conductive leads 304*a*. In addition, the terminals 300*a* on the retainer 300 may not be able to firmly clamp the conductive leads 304*a*. In another aspect, as the surfaces of the conductive leads 304*a* are all clad with insulative layers, the insulative layers of the conductive leads 304*a* must be removed before the conductive leads 304*a* are clamped by the terminals 300*a*. The package structure disclosed by U.S. Pat. No. 6,593,840 and No. 6,912,781 must be improved to skip the step of removing the insulative layers and solve the problem that the terminals 300*a* cannot firmly clamp the conductive leads 304*a*.

SUMMARY OF THE INVENTION

Accordingly, the present invention provides an electronic module of an electric connector, which is suitable for mass production, can avoid pulling apart the conductive leads, and solve the problem that the terminals cannot firmly clamp the conductive leads. Additionally, the present invention simplifies the step of removing the insulative layers of the conductive leads.

The present invention provides an electronic module of an electric connector. The electronic module is suitable for being electronically connected to a terminal set of the electric connector and is used to accommodate an electronic component, wherein the electronic component is a filter electronic component or other electronic components. A plurality of connection terminals is disposed on the terminal set and can be electrically connected with other electronic devices. The electronic module comprises a holder, at least an electronic component and a plurality of auxiliary terminals. The holder has an accommodating space and a plurality of terminal channels disposed around and at least partially communicated with the accommodating space. The electronic component is disposed in the accommodating space and has a plurality of conductive leads extending outside the accommodating space. Additionally, each auxiliary terminal has an insert end and an opposite connection end. The insert ends of the auxiliary terminals correspondingly inserted respectively into the terminal channels lead at least a portion of the conductive leads extending outside the accommodating space into the terminal channels. Moreover, the connection ends of the auxiliary terminals are electrically connected to the connection terminals respectively.

During the process of utilizing the auxiliary terminals to lead the conductive leads of the electronic component into the terminal channels of the holder, the auxiliary terminals rub with the conductive leads, such that wiping occurs between the auxiliary terminals and the conductive leads for removing the insulative layers cladding the conductive leads. The above design can effectively ensure the electrical connection between the auxiliary terminals and the conductive leads. Additionally, the auxiliary terminals and the terminal channels can firmly clamp the conductive leads, so as to ensure good reliability of the electrical connection therebetween and reduce the possibility of poor contact. Furthermore, the relative position between the auxiliary terminals and the conductive leads are fixed and the electrical connection therebetween is ensured by welding. The above feature of the present invention makes the welding between the auxiliary terminals and the conductive leads more reliable. Therefore, the electronic module disclosed by the present invention is suitable for mass production. Moreover, the fact that the conductive leads are led by the auxiliary terminals can prevent the conductive leads from being damaged by excessively great external forces.

In order to make the features and advantages of the present invention comprehensible, preferred embodiments accompanied with figures are described in detail below.

BRIEF DESCRIPTION OF THE DRAWINGS

FIG. 6B is a sectional view of FIG. 4 cut along the cutting plane P, rotated by 180° and observed along the arrow direction A.

DESCRIPTION OF EMBODIMENTS

The present invention provides an electronic module of an electric connector for solving the problems in the conventional art. The electronic module has an electronic component. The electronic component includes a plurality of conductive leads. As the relative position between the auxiliary terminals and the conductive leads is fixed, it is easy to weld the above two parts together, which (design) is advantageous to produce a large number of reliable electronic modules. Additionally, the auxiliary terminals lead the conductive leads to the aforementioned relative position to be electrically connected. Furthermore, while leading the conductive leads, the auxiliary terminals can simultaneously remove the insulative layers on the conductive leads, so as to simplify the removal process and hence to save the cost. The electronic module will be described in detail below.

Figure 1:
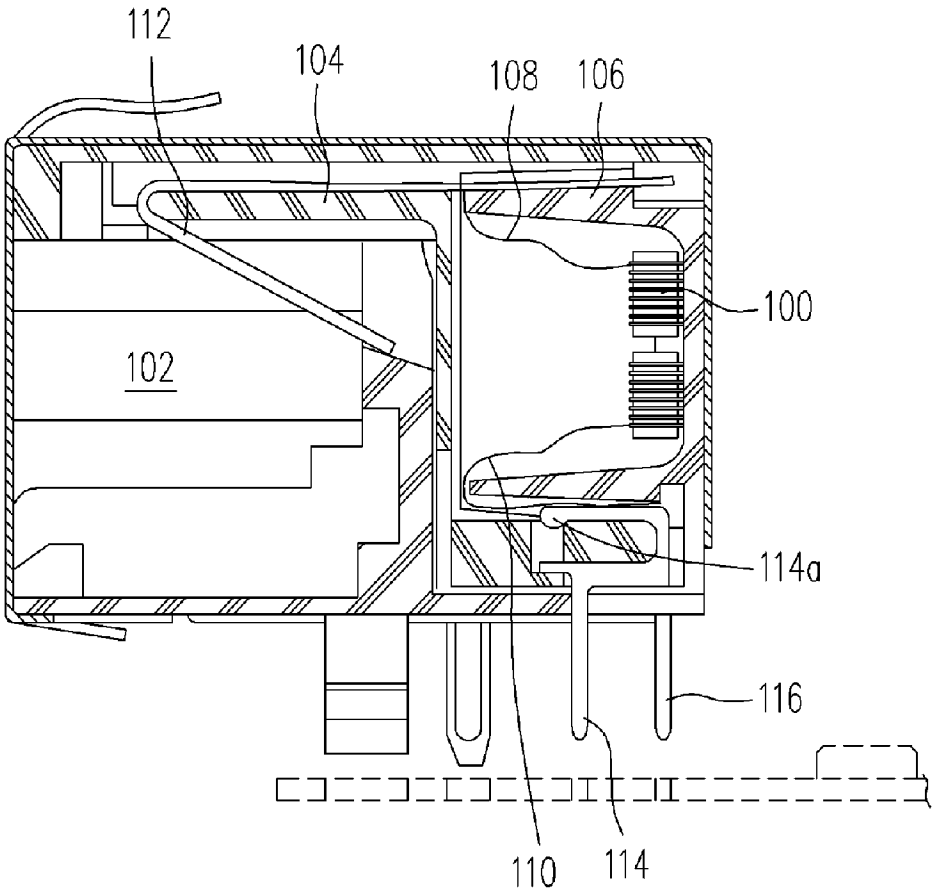
FIG. 1 (PRIOR ART)
FIG. 1 is a sectional view of a conventional modular jack with filter insert and contact therefore.
Figure 2:
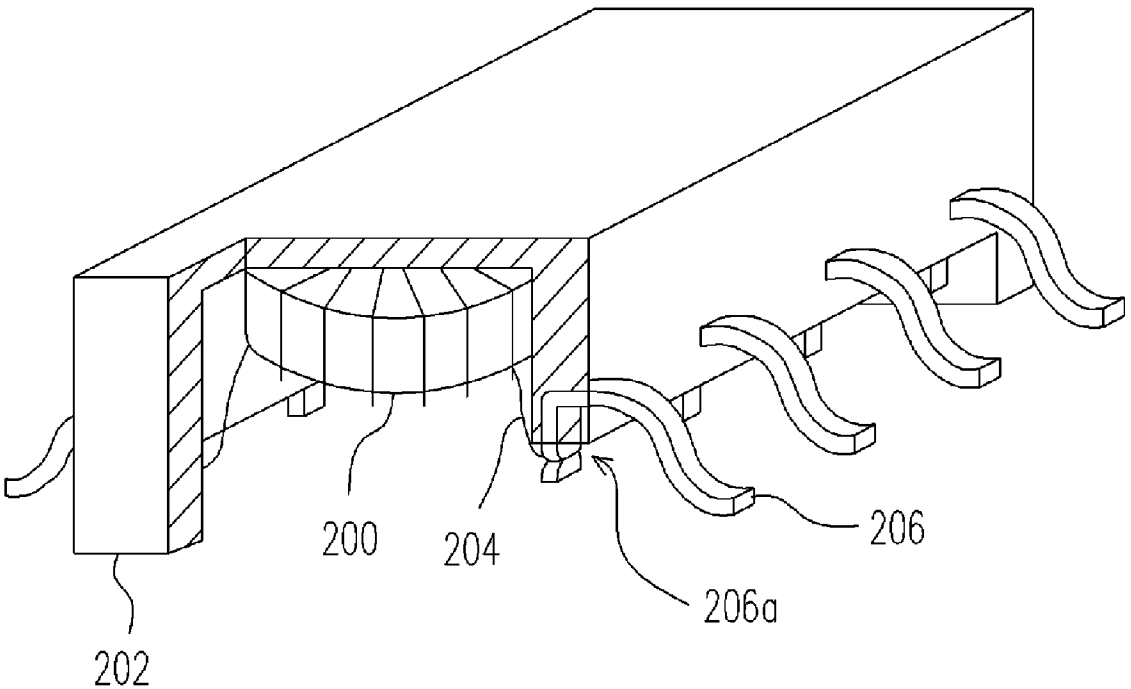
FIG. 2 (PRIOR ART)
FIG. 2 is a sectional view of an electronic component package structure containing a toroid filter coil.
Figure 3:
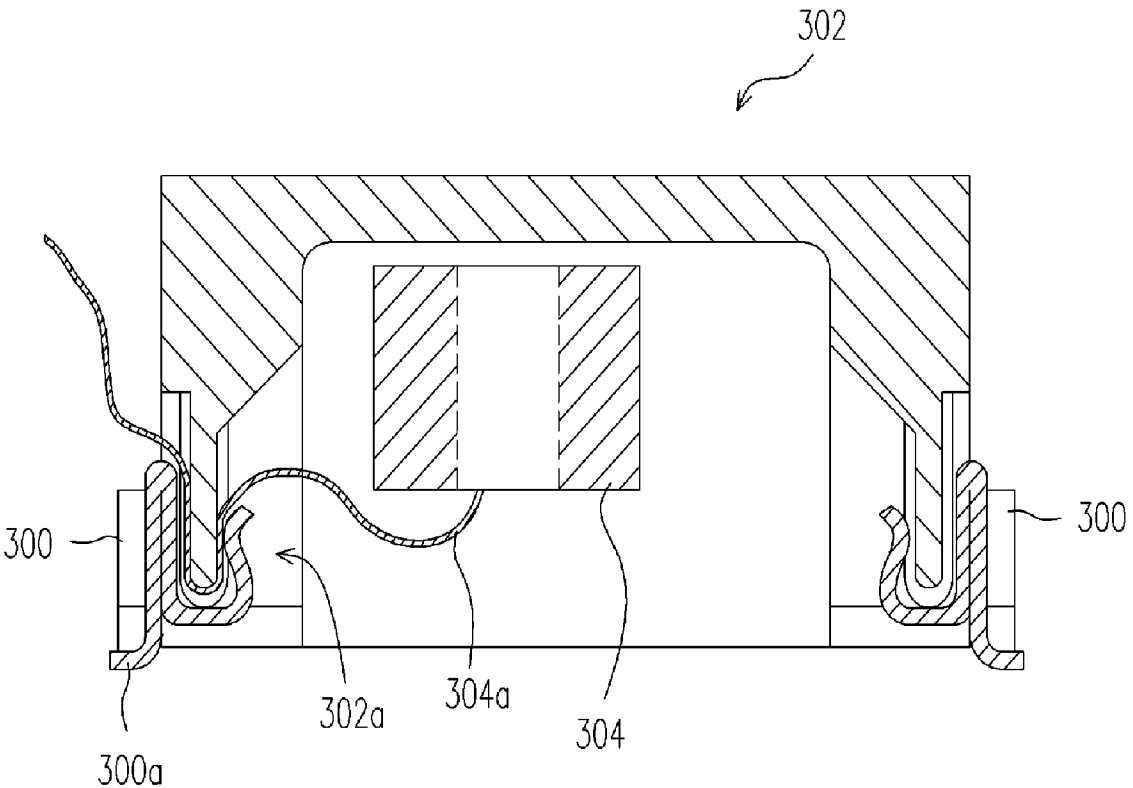
FIG. 3 (PRIOR ART)
FIG. 3 is a sectional view of an electronic component package structure that can be inserted by conductive leads.
Figure 4:
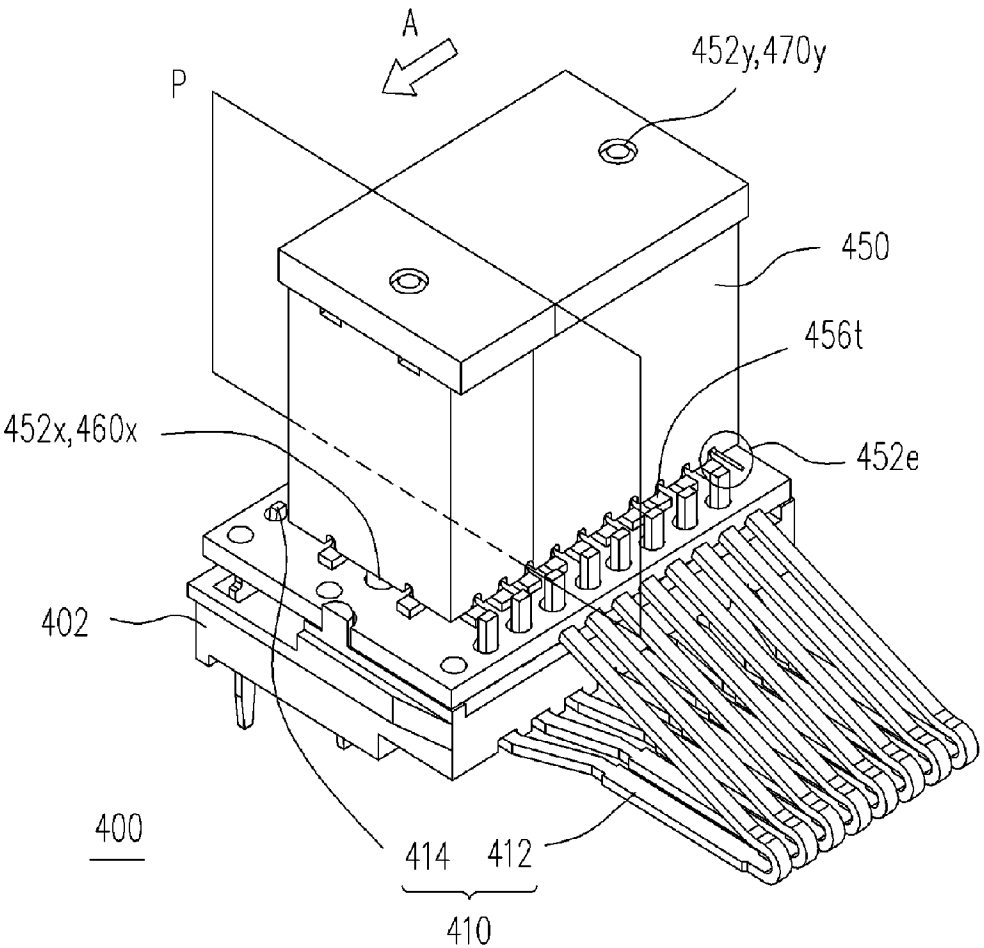
FIG. 4 is a stereogram of an electric connector according to an embodiment of the present invention.
Figure 5:
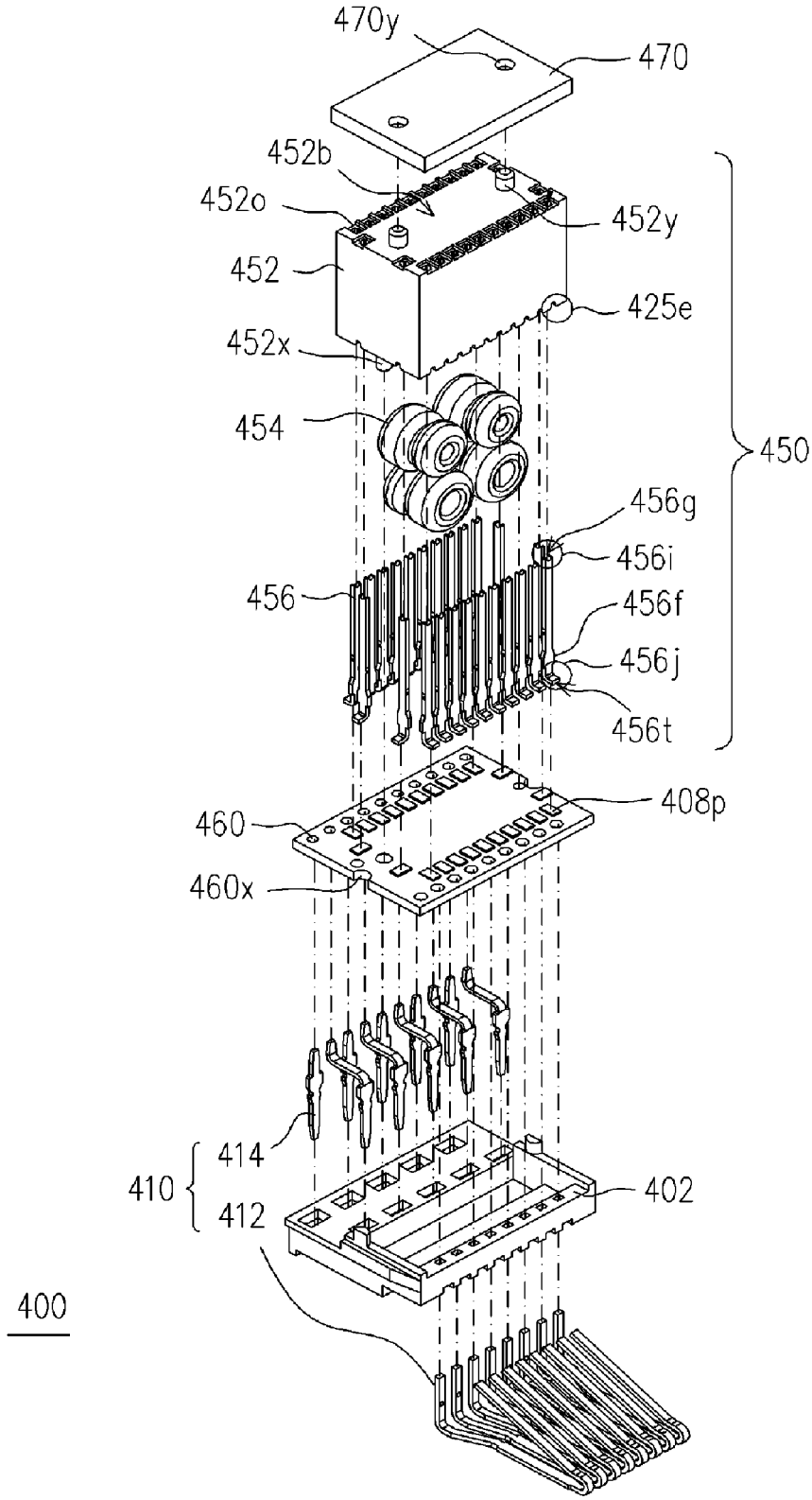
FIG. 5 is an exploded view of the electric connector in FIG. 4.

FIG. 4 is a stereogram of an electric connector according to an embodiment of the present invention. FIG. 5 is an exploded view of the electric connector in FIG. 4. FIG. 6B is a sectional view of FIG. 4 cut along the cutting plane P, rotated by 180° and observed along the arrow direction A. Therefore, compared with FIG. 4, the elements in FIG. 6B are placed upside down. Additionally, for the convenience of illustration, FIG. 6B only shows a portion of the elements in FIG. 4.

Referring to FIGS. 4, 5 and 6B, an electric connector 400 is provided with an electronic module 450 disclosed in the present invention, and the electronic module 450 is suitable for being electronically connected to a terminal set 402 inside the electric connector 400. A plurality of connection terminals 410 is disposed on the terminal set 402 and can be electrically connected to other electronic devices. In the present embodiment, the connection terminals 410 can be divided into a plurality of front terminals 412 and a plurality of back terminals 414 for electrically connecting two external electronic devices respectively.

The electronic module 450 includes a holder 452, at least one electronic component 454 and a plurality of auxiliary terminals 456. The holder 452 has an accommodating space 452*s* and a plurality of terminal channels 452*c* disposed around and at least partially communicated with the accommodating space 452*s*.

The electronic component 454 is disposed in the accommodating space 452*s* and has a plurality of conductive leads 454*w* extending outside the accommodating space 452*s*. The electronic component 454, for example, includes (but not limited to) a filter, resistor or inductor. In the present embodiment, the electronic component is a filter constituted by a set of coils, as shown in FIG. 5.

Figure 6A:
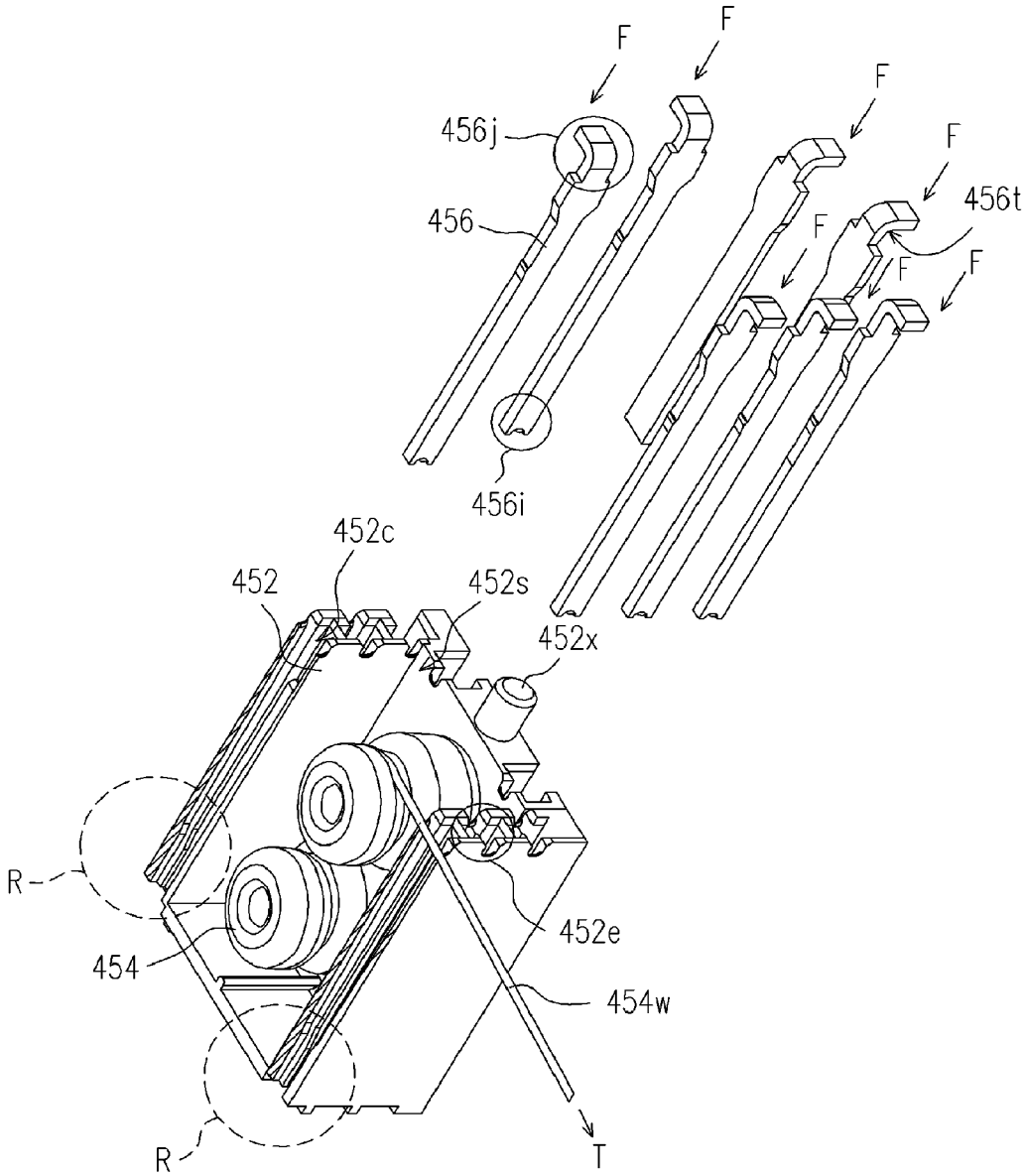
FIGS. 6A and 6B are a portion of the sectional views of the assembly flow of the electronic module according to an embodiment of the present invention, and are respectively two steps of assembling the electronic module.
Figure 6B:
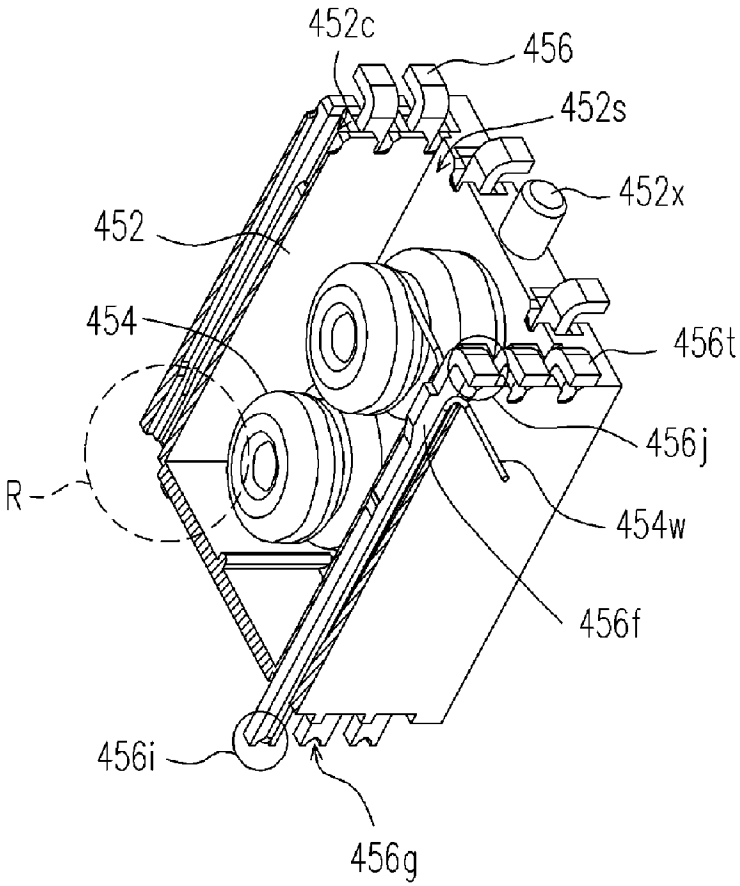

Being a portion of the sectional views of the assembly flow of the electronic module 450 according to an embodiment of the present invention, FIGS. 6A and 6B are respectively two steps of assembling the electronic module 450. Referring to FIGS. 6A and 6B, the method of assembling the electronic module 450 includes the following steps. For example, at first, the electronic component 454 is placed into the accommodating space 452*s*, and then the conductive leads 454*w* of an appropriate length extends outside the accommodating space 452*s* via entrances 452*e* of the terminal channels 452*c*. Additionally, a proper tensile force T is exerted on the conductive leads 454*w*, so as to straighten up a portion of the conductive leads 454*w* disposed at the entrances 452*e* of the terminal channels 452*c*.

Next, referring to FIG. 6B, the auxiliary terminals 456 lead at least a portion of the conductive leads 454*w* extending outside the accommodating space 452*s* into the terminal channels 452*c* via the communicated portion between the accommodating space 452*s* and the terminal channels 452*c*. As such, each auxiliary terminal 456 is electrically connected to the corresponding conductive lead 454*w* respectively. In another aspect, each auxiliary terminal 456 has an insertion end 4561 and an opposite connection end 456*j*, and the insertion ends 4561 are inserted into the terminal channels 452*c* correspondingly. The insertion ends 4561, for example, lead the conductive leads 454*w* by an appropriate thrust F, wherein the thrust F must be great enough to lead the conductive leads 454*w* against the tensile force T. Moreover, the thrust F must be smaller than the tensile strength of the conductive leads 454*w* for fear of pulling apart the conductive leads 454*w*. Additionally, in the present embodiment, the end surface of the insertion end 4561 of each auxiliary terminal 456 has a guiding cut 456*g* for leading the corresponding conductive lead 454*w* into the corresponding terminal channel 452*c* respectively. Moreover, the present invention is not limited to lead the conductive leads 454*w* via the guiding cuts 456*g*. In other words, based on the principle of the guiding cuts 456*g*, those of ordinary skill in the art may think of other variations, which include, but not limited to, for example, a terminal structure with an inverted hook or a terminal structure capable of clamping the conductive leads. Therefore, any terminal structure that can effectively lead the conductive leads 454*w* into the terminal channels 452*c* can be applied and derived.

As such, the conductive leads 454*w* are in the form of an inverted U-shape and cross the guiding cuts 456*g* of the auxiliary terminals 456. The insertion ends 4561 of the auxiliary terminals 456 rub with the insulative layers on the conductive leads 454*w* while leading the conductive leads 454*w* into the terminal channels 452*c*, thereby removing the insulative layers (not shown) on the conductive leads 454*w* at the same time. As such, the auxiliary terminals 456 are electrically connected to a portion of the conductive leads 454*w* with the insulative layer removed.

The connection ends 456*j* of the auxiliary terminals 456 are electrically connected to the aforementioned connection terminals 410. In the present embodiment, the auxiliary terminals 456 are connected to a daughterboard 460, and the daughterboard 460 is electrically connected to the connection terminals 410 on the terminal set 402 of the electric connector 400. Therefore, the electronic component 454 can be electrically connected with an outside circuit through the auxiliary terminals 456, the daughterboard 460 and the connection terminals 410.

Referring to FIGS. 5 and 6B, in the present embodiment, the terminal channels 452*c* communicated with the accommodating space 452*s* are a plurality of through holes penetrating the holder 452. However, in another feasible embodiment (not shown), the terminal channels 452*c* can also be a kind of blind hole, which is apparent to those skilled in the art and will not be described in detail herein. In the present embodiment, under the circumstance that the terminal channels 452*c* are through holes, the electronic module 450 can be further provided with an insulative cover 470 disposed on one side 452*b* away from the daughterboard 460, so as to cover openings 452*o* disposed at the side 452*b* of the terminal channels 452*c*. Additionally, before assembling the insulative cover 470, quality control staff can observe whether the auxiliary terminals 456 and conductive leads 454*w* are connected properly through the openings 452*o*. As the auxiliary terminals 456 and the conductive leads 454*w* are exposed at the openings 452*o*, it is quite easy for the auxiliary terminals 456 (insertion terminals 4561) on the side 452*b* of the daughterboard 460 to electrically contact other portions of the electric connector 400, for example, to electrically contact the housing for shielding electromagnetic interference outside the electric connector 400 or other modules inside the electric connector 400. Therefore, the insulative cover 470 is disposed to reduce the possibility of the occurrence of the above problem.

In another aspect, as for the electronic module 450, the corresponding insertion ends 4561 of the auxiliary terminals 456 can also be respectively connected to the conductive leads 454*w* by solder. The welding of the insertion ends 4561 and the conductive leads 454*w* is meant to further ensure that (the insertion ends 4561 of) the auxiliary terminals 456 are electrically connected to the corresponding conductive leads 454*w* respectively, thereby avoiding poor contact. The welding method includes, but not limited to, for example, dipping the insertion ends 4561 of the auxiliary terminals 456 into a tin solution to dissolve the insulative layers on the conductive leads 454*w* by the high temperature of the tin solution and weld the conductive leads 454*w* and the auxiliary terminals 456 into one-piece through the tin solution remained on the conductive leads 454*w* and the auxiliary terminals 456. Additionally, the insulative layer can also be removed by flame, which is also apparent to those skilled in the art and will not be described in detail herein. Furthermore, compared with the conventional art, the auxiliary terminals 456 and the conductive leads 454*w* are welded together more easily and more sufficiently in the present embodiment. That is because the relative position between the insertion ends 4561 of the auxiliary terminals 456 and the conductive leads 454*w* is fixed, and the portion at the openings 452*o* is exposed, thus facilitating the observation and welding step at the openings 452*o*. However, when the terminals and the conductive leads of a conventional electronic module are to be welded together, as the conductive leads and panels (such as metal wires and panels) have no fixed relative position, it is difficult to perform the welding process. Therefore, according to the comparison, the present invention is more suitable for industrial mass production of reliable electronic modules than the conventional art.

Referring to FIGS. 4 and 5, the daughterboard 460 is electrically connected to the connection ends 456*j* of the auxiliary terminals 456 and the connection terminals 410 on the terminal set 402. The electronic circuits on the daughterboard 460 may have various circuit configurations accompanying the electronic component 454, thereby presenting electrical properties on various demands. Additionally, the connection end 456*j* of each auxiliary terminal 456 can be bent to form a solder tail 456*t*. The solder tail 456*t* is suitable for being bounded to the daughterboard 460 by the surface mounting technology (SMT). However, the shape of the solder tail 456*t* and the configuration between the solder tail 456*t* and the daughterboard 460 can be altered according to the requirements for assembling and manufacturing and are not limited to those shown in the figures. For example, the aforementioned shape and configuration include, but not limited to, directly inserting the solder tail 456*t* in the present embodiment into the daughterboard 460, which is not shown, but is apparent to those skilled in the art and thus will not be described in detail herein. Based on the above configuration, the electronic component 454 can be electrically connected to external circuits via the auxiliary terminals 456, the daughterboard 460 and the connection terminals 410.

Figure 7:
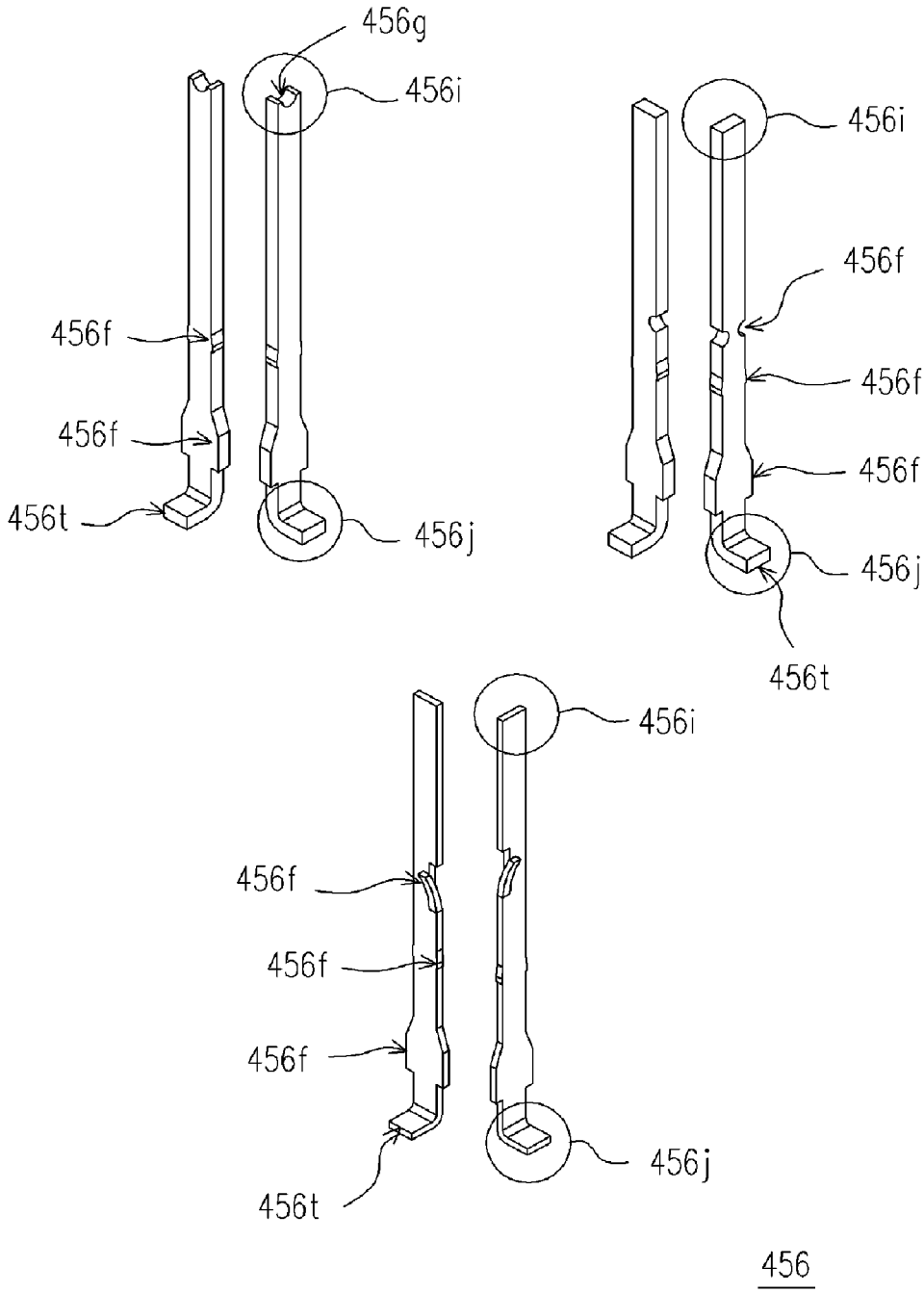
FIG. 7 shows various auxiliary terminals of the electronic module according to an embodiment of the present invention.

FIG. 7 shows the implementation aspects of various auxiliary terminals 456 of the electronic module 450 according to an embodiment of the present invention. Referring to FIG. 7, the auxiliary terminal 456 may have an interference structure 456*f*, which can form interference between the auxiliary terminal 456 and the inner wall of the terminal channel 452*c* after the auxiliary terminal 456 is inserted into the corresponding terminal channel 452*c* respectively, so as to clamp the corresponding auxiliary terminal 456. The interference structure 456*f* can be a protrusion or recess on the side of the auxiliary terminals 456. The main difference of the various auxiliary terminals 456 in FIG. 7 also lies in the interference structures 456*f* of different shapes. It is obvious that the shapes of the interference structure 456*f* can be altered according to the requirements of the designer and is not limited to those shown in FIG. 7. As the auxiliary terminals 456 are provided with the interference structures 456*f*, the auxiliary terminals 456 and the conductive leads 454*w* are firmly clamped in the terminal channels 452*c*.

In order to form interference between the auxiliary terminals 456 and the inner walls of the terminal channels 452*c*, the auxiliary terminals 456 may have the above interference structures 456*f*. However, in another embodiment, other methods can be employed to form interference. For example, but not limited to, the inner wall of each terminal channel 452*c* can have an interference structure (not shown), which is used to form interference with the inserted auxiliary terminal 456 correspondingly, so as to together clamp the corresponding conductive lead 454*w* respectively. The interference structure disposed on the inner wall of the terminal channel 452*c* includes, but not limited to, the convergent portion of the inner diameter of the terminal channel 452*c*. The convergent portion of the inner diameter forms a neck portion, and due to the interference structure, the auxiliary terminal 456 and the conductive lead 454*w* are pressed and clamped, so as to ensure the stable electrical connection between the auxiliary terminal 456 and the conductive lead 454*w*.

Another design of the interference structure is different from that described in FIG. 7, but also feasible. Referring to the region R marked in FIGS. 6A and 6B, in this design, the centers of the entrance and exit of the terminal channel 452*c* are offset slightly, such that the auxiliary terminal 456 is forcedly distorted by the terminal channel 452*c*, and then the auxiliary terminal 456 is retained in the terminal channel 452*c* by the restoring force generated after the auxiliary terminal 456 is distorted. It is obvious that, besides the above design, the same principle may be slightly altered. For example, the centers of the terminal channel 452*c* can be arranged into a circular arc or an irregular form.

Referring to FIGS. 4, 5, 6A and 6B, the daughterboard 460 includes a plurality of circuit pads 460*p*. As shown in FIG. 6B, after the holder 452, the electronic component 454 and the auxiliary terminals 456 are assembled, the connection ends 456*j* of the auxiliary terminals 456 are electrically connected to the circuit pads 460*p* respectively. In order to align each connection end 456*j* with the corresponding circuit pad 460*p*, the daughterboard 460 and the holder 452 include, for example, but not limited to, a first positioning structure 460*x* and a second positioning structure 452*x* matching each other. The first positioning structure 460*x* includes two segmental orifices in two opposite sides of the daughterboard 460 and the second positioning structure 452*x* includes a plurality of guiding columns corresponding to the segmental orifices. Additionally, the segmental orifices may have different sizes or shapes, so as to match the corresponding guiding columns. For example, as shown in the figures, the first positioning structure 460*x* includes two segmental orifices, wherein one is large and the other is small. Correspondingly, the second positioning structure 452*x* includes two guiding columns, wherein one is large and the other is small. The larger guiding column matches the larger segmental orifice and the smaller guiding column matches the smaller segmental orifice. The above design can be used to prevent the holder 452 and the daughterboard 460 from being improperly assembled.

Similarly, in the present embodiment, a positioning structure 452*y* is disposed on one side 452*s* of the holder 452, and a positioning structure 470*y* is disposed on the insulative cover 470 corresponding to the positioning structure 452*y*, so as to facilitate the alignment and assembly.

In view of the above, the present invention at least has the following advantages:

1. The auxiliary terminals and the terminal channels can firmly clamp the conductive leads, such that the electrical connection therebetween has good reliability.

2. The relative position between the auxiliary terminals and the conductive leads is fixed, so as to facilitate the process of welding the auxiliary terminals and the conductive leads and to make the welding structure more reliable. Therefore, the electronic module of the present invention is suitable for mass production.

3. A suitable thrust is exerted onto the auxiliary terminals to lead the conductive leads, so as to prevent the conductive leads being damaged by excessively great external forces, thereby improving the product yield.

4. As the auxiliary terminals can effectively remove the insulative layers on the conductive leads, the step of removing the insulative layers is unnecessary during the process of assembling the electronic modules. Therefore, the present invention can simplify the process of assembling the electronic module.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. An electronic module of an electric connector suitable for being electrically connected to a terminal set inside the electric connector wherein a plurality of connection terminals is installed on the terminal set for electrically connecting other devices comprising:

a holder, having an accommodating space and a plurality of terminal channels disposed around the accommodating space, wherein the accommodating space is at least partially communicated with each of the terminal channels;

at least one electronic component, disposed in the accommodating space and having a plurality of conductive leads extending outside the accommodating space; and a plurality of auxiliary terminals, wherein each of the auxiliary terminals has a connection end and an insertion end opposite to each other, the insertion ends lead at least parts of the conductive leads extending outside the accommodating space into the terminal channels while being correspondingly inserted into the terminal channels, and the connection ends are electrically connected to the connection terminals.

2. The electronic module as claimed in claim 1, wherein the connection ends of each of the auxiliary terminals are electrically connected to a daughterboard, the daughterboard is further electrically connected to the connection terminals on the terminal set of the electric connector, such that the electronic component is electrically connected to an external circuit through the auxiliary terminals, the daughterboard and the connection terminals.

3. The electronic module as claimed in claim 1, wherein the terminal channels are a plurality of through holes penetrating the holder.

4. The electronic module as claimed in claim 3, further comprising an insulative cover disposed on one side of the terminal channels away from the daughterboard, so as to cover the openings of the terminal channels disposed at the side.

5. The electronic module as claimed in claim 3, further comprising a solder for electrically connecting the connection ends of the auxiliary terminals and the corresponding conductive leads.

6. The electronic module as claimed in claim 1, wherein the terminal channels are a plurality of blind holes.

7. The electronic module as claimed in claim 1, wherein the electronic component is a resistor or an inductor.

8. The electronic module as claimed in claim 1, wherein the electronic component is a filter.

9. The electronic module as claimed in claim 1, wherein the end surface of the insertion end of each auxiliary terminal has a guiding cut for guiding the conductive leads into the corresponding terminal channels.

10. The electronic module as claimed in claim 2, wherein the connection end of each of the auxiliary terminals is bent to form a solder tail, and the solder tail is bounded to the daughterboard by the surface mounting technology (SMT).

11. The electronic module as claimed in claim 1, wherein each of the auxiliary terminals has an interference structure for forming interference between each of the auxiliary terminals and the inner wall of the corresponding terminal channel after the auxiliary terminal is inserted into the terminal channel, so as to clamp the corresponding conductive lead.

12. The electronic module as claimed in claim 11, wherein the interference structure is a protrusion on the side of the auxiliary terminal.

13. The electronic module as claimed in claim 1, wherein the inner wall of each of the terminal channel has an interference structure, and the interference structure retains the auxiliary terminal in the terminal channel by making the centers of the entrance and exit of the terminal channel offset slightly and utilizing the restoring force generated after the auxiliary terminal is distorted.

14. The electronic module as claimed in claim 13, wherein the interference structure is a convergent portion of the inner diameter of the terminal channel.

15. The electronic module as claimed in claim 2, wherein the daughterboard and the holder respectively have a first positioning structure and a second positioning structure matching each other.

16. The electronic module as claimed in claim 15, wherein the first positioning structure comprises two segmental orifices in two opposite sides of the daughterboard and the second positioning structure comprises a plurality of guiding columns corresponding to the segmental orifices.

17. The electronic module as claimed in claim 16, wherein the segmental orifices have different sizes or shapes to match the corresponding guiding columns.

* * * * *